US012742367B2

(12) United States Patent
Radojevic et al.

(10) Patent No.: US 12,742,367 B2
(45) Date of Patent: Sep. 22, 2026

(54) ACTUATION CYLINDER FOR INSIDE BLOW-OUT PREVENTER VALVE

(71) Applicant: Warrior Rig Technologies US LLC, Springtown, TX (US)

(72) Inventors: Dragan Radojevic, Azle, TX (US); Pavel Shpak, Azle, TX (US)

(73) Assignee: Patterson-UTI Drilling Company LLC, Houston, TX (US)

( * ) Notice: Subject to any disclaimer, the term of this patent is extended or adjusted under 35 U.S.C. 154(b) by 167 days.

(21) Appl. No.: 18/677,460

(22) Filed: May 29, 2024

(65) Prior Publication Data

US 2024/0401433 A1 Dec. 5, 2024

Related U.S. Application Data

(60) Provisional application No. 63/506,004, filed on Jun. 2, 2023.

(51) Int. Cl.
*E21B 34/08* (2006.01)
*E21B 34/16* (2006.01)

(52) U.S. Cl.
CPC ..... *E21B 34/08* (2013.01); *E21B 34/16* (2013.01)

(58) Field of Classification Search
CPC ..... E21B 19/07; E21B 19/16; E21B 19/086; E21B 29/08; E21B 33/063; E21B 33/06; E21B 33/061; E21B 34/02; E21B 34/045; E21B 33/062; E21B 34/08; E21B 34/16; Y10T 83/8858; F15B 2013/0409; F15B 15/14; F15B 15/149; F15B 15/28; F15B 20/004
USPC ..... 166/383, 77.51, 379 OR, 85.4, 86.2; 251/325, 1.1, 1.2, 1.3, 62, 63, 63.5; 137/557
See application file for complete search history.

(56) References Cited

U.S. PATENT DOCUMENTS 3,036,807 A * 5/1962 Lucky ..... F16K 3/0254 251/38
3,938,549 A * 2/1976 Nunneley ..... G08B 1/04 116/272
6,244,560 B1 * 6/2001 Johnson ..... E21B 33/063 92/61

(Continued)

FOREIGN PATENT DOCUMENTS

CN 111637113 B * 7/2022 ..... F15B 15/149

OTHER PUBLICATIONS

CN111637113B, Gao, Machine Translation (Year: 2022).*

*Primary Examiner* — Daphne M Barry
(74) *Attorney, Agent, or Firm* — Chernoff, Vilhauer, McClung & Stenzel LLP

(57) ABSTRACT

An inside blow-out preventer (IBOP) actuation cylinder may comprise a first hydraulic fluid port and a second hydraulic fluid port. The IBOP actuation cylinder may also comprise a movable cylinder. The cylinder may be movable by pressurized hydraulic fluid from the first or second hydraulic fluid ports. The movable cylinder may be couplable to an IBOP valve or an IBOP valve actuation mechanism. Movement of the movable cylinder may open or close the IBOP valve. The IBOP actuation cylinder may also comprise a pilot port fluidly couplable to at least one pressure sensor configurable to detect pressure of fluid from the pilot port to determine a state of the movable cylinder.

10 Claims, 8 Drawing Sheets

(56) References Cited

U.S. PATENT DOCUMENTS

| | | | | |
|---|---|---|---|---|
| 8,464,795 | B2 * | 6/2013 | Dyson | E21B 33/043 137/496 |
| 2002/0124889 | A1 * | 9/2002 | Sundararajan | F16K 37/0008 137/559 |
| 2007/0251700 | A1 * | 11/2007 | Mason | E21B 19/06 166/380 |
| 2010/0193198 | A1 * | 8/2010 | Murray | E21B 19/07 166/380 |
| 2014/0116040 | A1 * | 5/2014 | Heintz | F15B 15/16 60/416 |
| 2019/0316463 | A1 * | 10/2019 | Pfrenger | E21B 47/13 |

* cited by examiner

ACTUATION CYLINDER FOR INSIDE BLOW-OUT PREVENTER VALVE

REFERENCE TO RELATED APPLICATIONS

This application claims priority from, and the benefit under 35 USC in relation to, U.S. application No. 63/506,004 filed 2 Jun. 2023 which is hereby incorporated herein by reference.

FIELD

The present disclosure relates to actuation cylinders for inside blow-out preventer valves and related methods.

BACKGROUND

Inside blow-out preventer (IBOP) valves are important safety devices of an oil drilling operation. Specifically, IBOP valves prevent blowouts (e.g., uncontrolled backflow of drilling mud, oil, etc.) of a drilling operation. It is critical for an operator of a drilling operation to know whether an IBOP valve is open or closed so that the operator can safely commence or continue the drilling operation.

Present technologies for monitoring the status (e.g., a current operating state) of an IBOP valve are unreliable. In particular, existing systems that monitor the status of IBOP valves will report that the IBOP valve is CLOSED if a particular directional valve in the IBOP valve actuation mechanism is in a closed configuration and the system pressure at a particular input port in the IBOP valve actuation mechanism is greater than 1400 psi. A problem is that neither of these conditions is a direct indication of the position of the IBOP valve actuation cylinder. In particular, either or both of these conditions can occur when the IBOP valve is OPEN, creating potentially dangerous false positive IBOP valve status indication. Similarly, the conditions used by current systems to indicate that the IBOP valve is OPEN are not directly indicative of the position of the IBOP valve actuation cylinder. By way of non-limiting example, the conditions used by current systems to indicate the status of the IBOP valve can be particularly problematic and lead to false positive indications in circumstances where the drilling operation stops and re-starts.

There is a need for improved systems and methods for monitoring operating states of IBOP valves. There is a desire for such systems and methods to be directly indicative of the position and/or configuration of the IBOP valve actuation cylinder or otherwise directly indicative of the position and/or configuration of the IBOP valve actuation cylinder.

SUMMARY

This invention has a number of aspects. These include without limitation:

- actuation cylinders for IBOP valves;
- systems and methods for detecting and/or monitoring operating states of IBOP actuation cylinders;
- systems and methods for detecting and/or monitoring operating states of IBOP valves.

One aspect of the invention provides an inside blow-out preventer (IBOP) actuation cylinder. The IBOP actuation cylinder may comprise a first hydraulic fluid port. The IBOP actuation cylinder may also comprise a second hydraulic fluid port. The IBOP actuation cylinder may also comprise a movable cylinder. The cylinder may be movable by pressurized hydraulic fluid from the first or second hydraulic fluid ports (e.g., by a difference in hydraulic fluid pressure between the first and second hydraulic fluid ports). The movable cylinder may be couplable to an IBOP valve or an IBOP valve actuation mechanism. Movement of the movable cylinder may open or close the IBOP valve. The IBOP actuation cylinder may also comprise a pilot port fluidly couplable to at least one pressure sensor configurable to detect pressure of fluid from the pilot port to determine a current state of the movable cylinder.

The IBOP actuation cylinder may comprise a first cavity fluidly coupled to a high pressure one of the first and second hydraulic fluid ports and a second cavity fluidly coupled to a low pressure one of the first and second hydraulic fluid ports. The pilot port may be fluidly coupled to the first cavity when the movable cylinder is retracted and the pilot port may be fluidly coupled to the second cavity when the movable cylinder is extended.

The IBOP actuation cylinder may comprise a first fluid passage extending through the movable cylinder. The first fluid passage may fluidly couple the first cavity with the high pressure one of the first and second hydraulic fluid ports. The IBOP actuation cylinder may also comprise a second fluid passage extending through the movable cylinder. The second fluid passage may fluidly couple the second cavity with the low pressure one of the first and second hydraulic fluid ports.

The IBOP actuation cylinder may comprise a first fluid seal between the first and second cavities.

The first fluid seal may comprise an O-ring and/or some other form of hydraulic seal.

The IBOP actuation cylinder may comprise a plurality of valves configured to fluidly couple the high pressure one of the first and second hydraulic fluid ports to the first fluid passage and the low pressure one of the first and second hydraulic fluid ports to the second fluid passage.

The plurality of valves may comprise a plurality of one-way valves.

The IBOP actuation cylinder may comprise at least a second fluid seal between the first hydraulic port and the second hydraulic port.

The second fluid seal may comprise an O-ring and/or some other form of hydraulic seal.

The plurality of valves may be configured to accommodate a switch in pressure of the first and second hydraulic fluid ports from a first state where the first one of the first and second hydraulic fluid ports is the high pressure one of the first and second hydraulic fluid ports and the second one of the first and second hydraulic fluid ports is the low pressure one of the first and second hydraulic fluid ports to a second state where the second one of the first and second hydraulic fluid ports is the high pressure one of the first and second hydraulic fluid ports and the first one of the first and second hydraulic fluid ports is the low pressure one of the first and second hydraulic fluid ports, while continuing to direct high-pressure hydraulic fluid from the first and second hydraulic fluid ports to the the first fluid passage and low-pressure hydraulic fluid from the first and second hydraulic fluid ports to the second fluid passage.

In some embodiments when the cylinder is retracted the first cavity comprises high pressure hydraulic fluid.

The high pressure hydraulic fluid comprises hydraulic fluid having a pressure of at least about 500 PSI.

Another aspect of the invention provides a method for determining a current operating state of an inside blow-out preventer (IBOP) actuation cylinder. The method may comprise detecting pressure of fluid present at a pilot port of the IBOP actuation cylinder using at least one pressure sensor.

The method may also comprise based on the detected pressure determining the current operating state of the IBOP actuation cylinder.

The IBOP actuation cylinder may comprise a cylinder moveable between an extended position (e.g., to open the IBOP valve) and a retracted position (e.g., to close the IBOP valve). Detecting pressure of fluid present at the pilot port of the IBOP actuation cylinder may comprise fluidly connecting the pilot port to a source of high-pressure hydraulic fluid when the moveable cylinder is in one of the extended position and the retracted position and fluidly connecting the pilot port to a source of high-pressure hydraulic fluid when the moveable cylinder is in the other one of the extended position and the retracted position.

Detecting pressure of fluid present at the pilot port of the IBOP actuation cylinder may comprise fluidly connecting the pilot port to a source of high-pressure hydraulic fluid only when the moveable cylinder is in one of the extended position and the retracted position and fluidly connecting the pilot port to a source of high-pressure hydraulic fluid only when the moveable cylinder is in the other one of the extended position and the retracted position.

The source of high-pressure hydraulic fluid and the source of low-pressure hydraulic fluid may be the same sources of hydraulic fluid that move the cylinder between its extended and retracted positions.

The sources of high-pressure and low-pressure hydraulic fluid may be provided via first and second fluid passages that extend through a body of the cylinder.

The method may comprise providing for an operator an indicator corresponding to a current operating state of the IBOP actuation cylinder.

Providing the indicator may comprise at least one of illuminating a light device, controlling a speaker, controlling a display and controlling a network notification device when the IBOP actuation cylinder is retracted.

Further aspects and example embodiments are illustrated in the accompanying drawings and/or described in the following description.

It is emphasized that the invention relates to all combinations of the above features, even if these are recited in different claims.

BRIEF DESCRIPTION OF THE DRAWINGS

The accompanying drawings illustrate non-limiting example embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Figure 1:
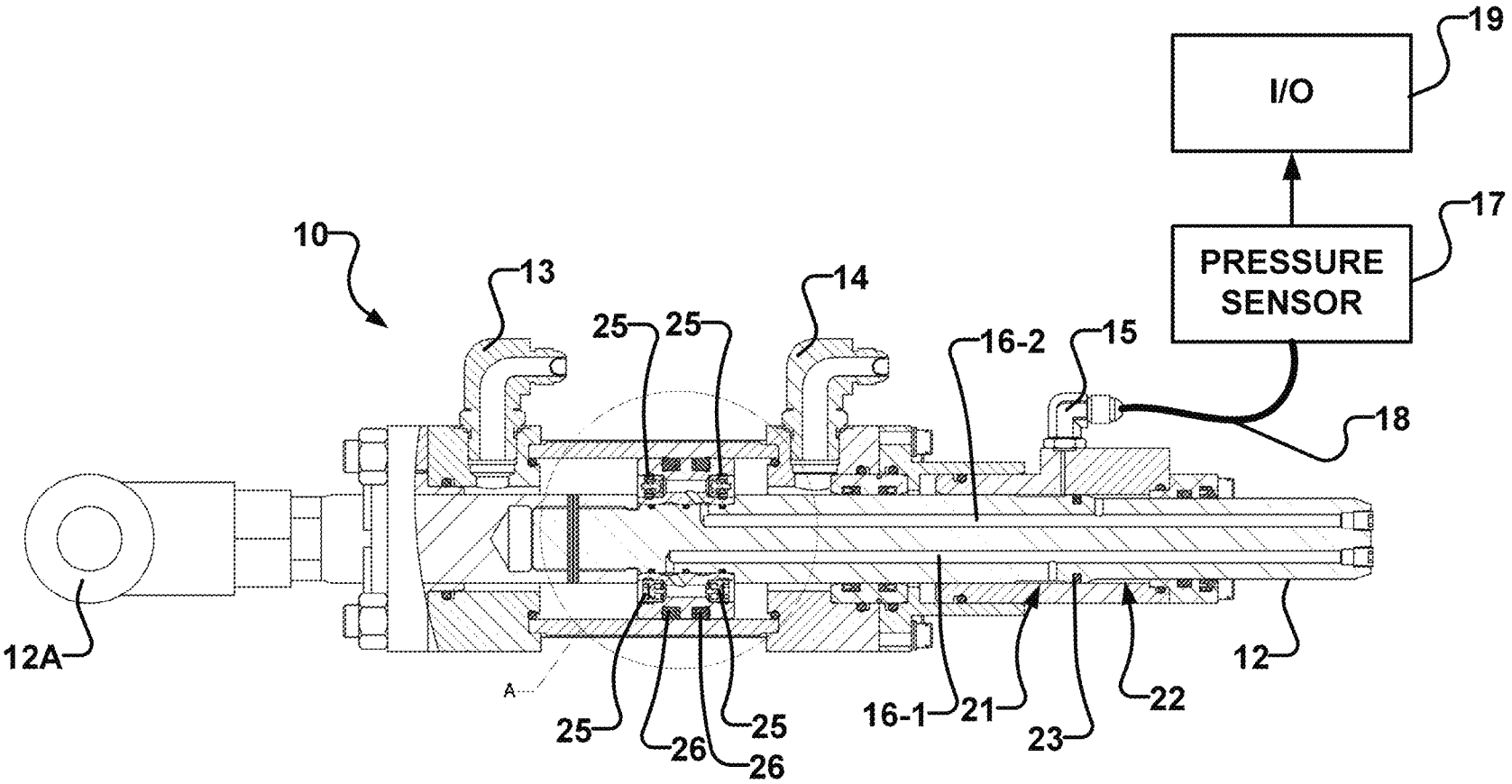
FIG. 1 is a partial cross-sectional view of an example IBOP actuation cylinder.

FIG. 1 is a partial cross-sectional view of inside blow-out preventer (IBOP) actuation cylinder 10. IBOP actuation cylinder 10 may be actuated to open and close an IBOP valve of an oil and gas drilling rig. The IBOP valve may be any commercially available IBOP valve.

Figure 5A:
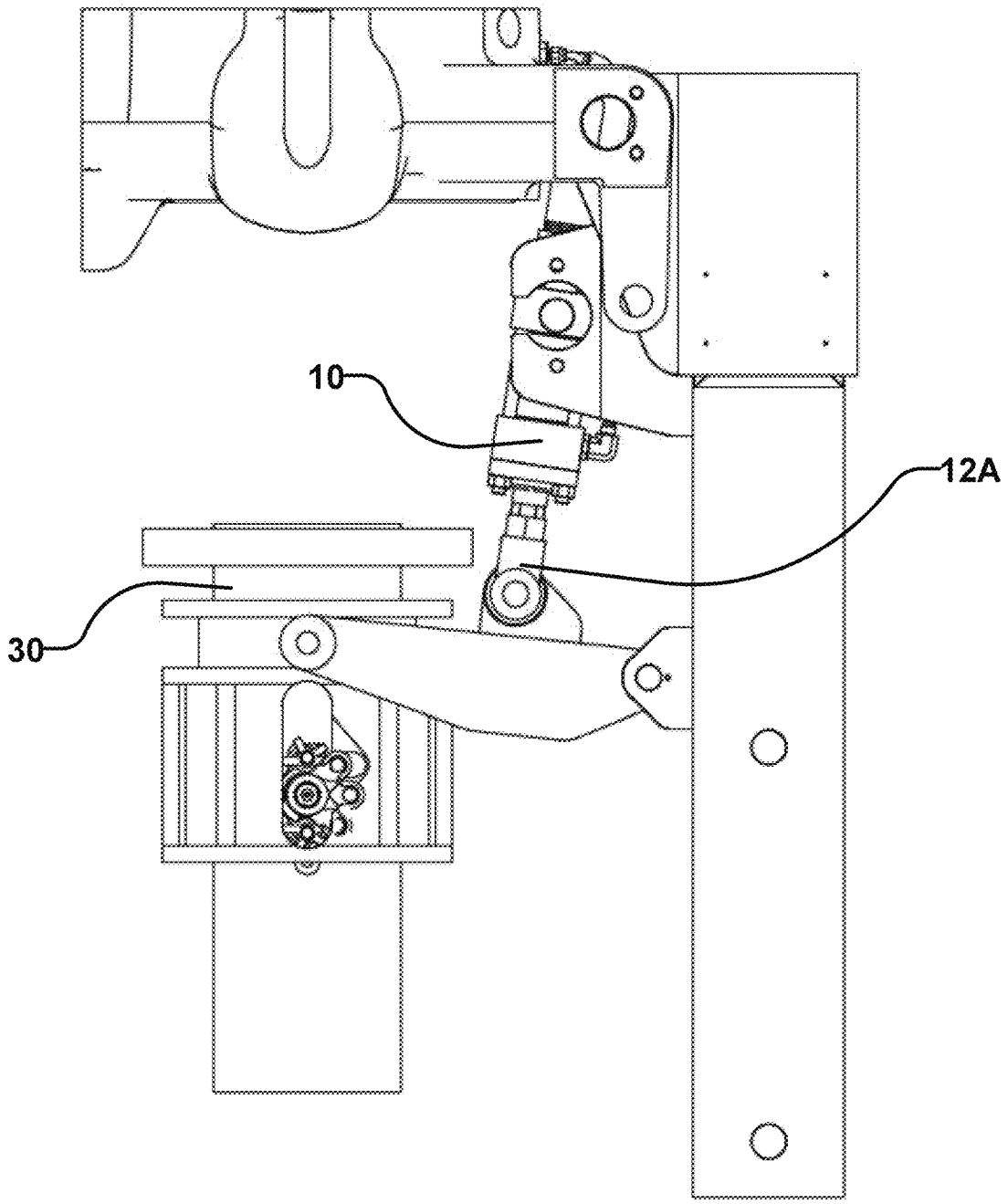
FIG. 5A is a side view of an example IBOP actuation cylinder actuating an IBOP valve into a closed state.
Figure 5B:
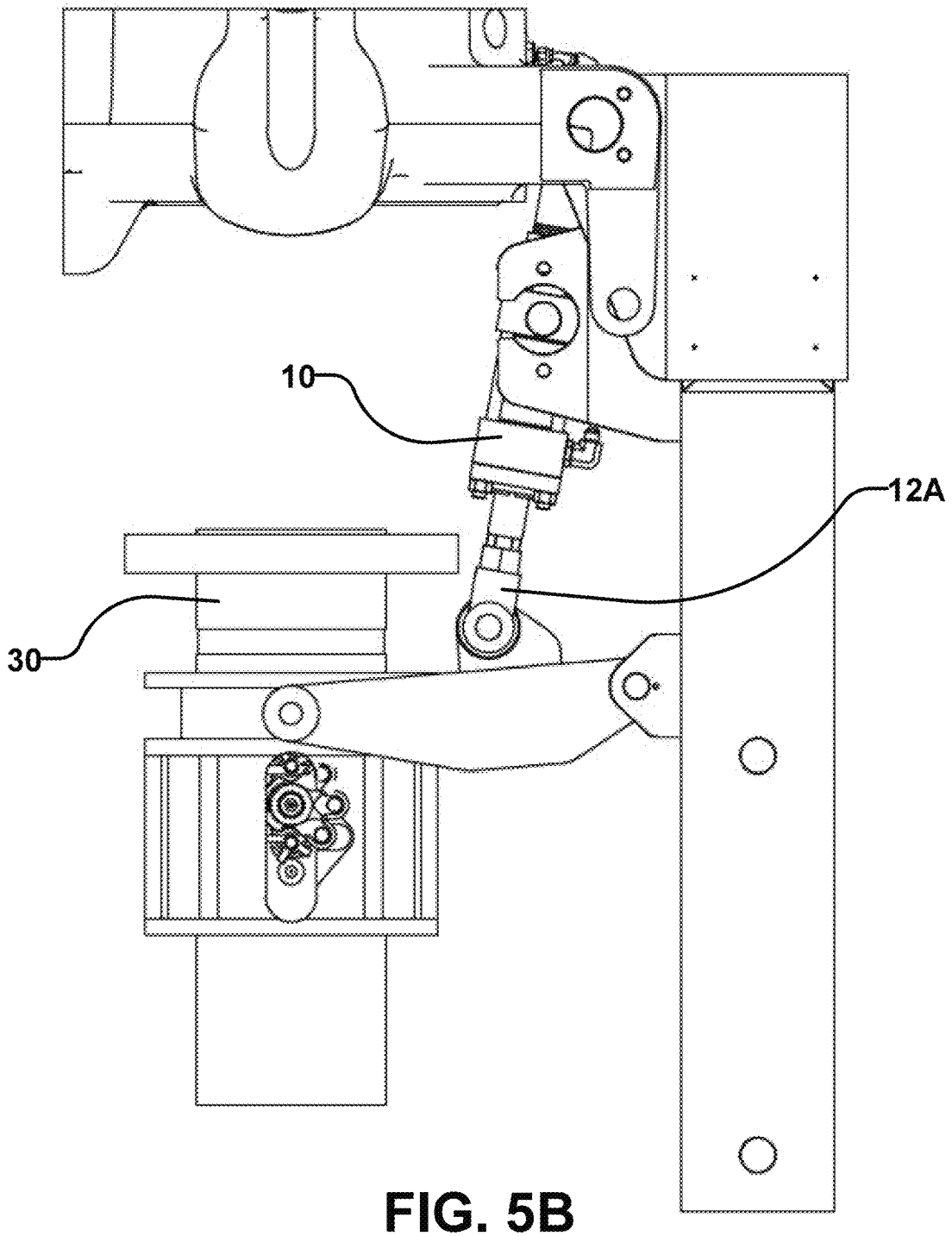
FIG. 5B is a side view of an example IBOP actuation cylinder actuating an IBOP valve into an open state.

IBOP actuation cylinder 10 comprises a hydraulically actuated cylinder 12 and hydraulic ports 13 and 14. An end 12A of cylinder 12 may, for example, be coupled to an actuation mechanism which opens or closes an IBOP valve (see e.g., FIG. 5A where IBOP valve 30 is closed and FIG. 5B where IBOP valve 30 is open). Hydraulic lines may be coupled to hydraulic ports 13 and 14. In the example embodiment illustrated in FIG. 1, providing high pressure (e.g., about 500-3000 PSI in some embodiments) hydraulic fluid via port 13 while providing a low pressure (e.g., less than about 100 PSI in some embodiments) return line via port 14 retracts cylinder 12 thereby closing the IBOP valve. Conversely, providing high pressure hydraulic fluid via port 14 while providing a low pressure return line via port 13 extends cylinder 12 thereby opening the IBOP valve. It will be appreciated, however, that the pressure on either one of ports 13, 14 is not directly indicative of the position/configuration of cylinder 12. For example, cylinder 12 may initially be in an extended state (i.e. IBOP open with high pressure hydraulic fluid at port 14 and low pressure hydraulic fluid at port 13) and then the pressure at ports 13, 14 may be switched to provide high pressure hydraulic fluid at port 13 and low pressure hydraulic fluid at port 14, but cylinder 12 may be jammed and may not retract or may take some time to transition from its extended state to its retracted state. In this example circumstance, using the pressure at either of ports 13, 14 as an indicator of the condition of the IBOP valve may lead to erroneous conclusions because the pressure at ports 13, 14 is not directly indicative of the position of cylinder 12.

IBOP actuation cylinder 10 also comprises a pilot port 15. Pilot port 15 is fluidly coupled to internal hydraulic fluid passages 16 as described elsewhere herein. An output of pilot port 15 may be coupled to one or more sensors 17 (for example by using a pilot line 18). One or more sensors 17 may comprise one or more fluid pressure sensors. By sensing pressure of the fluid from pilot port 15, a current operating state of IBOP actuation cylinder 10 (i.e., cylinder 12 extended or retracted) may be determined from which a current operating state of the IBOP valve may reliably be determined. In the example embodiment illustrated in FIG. 1, sensing high fluid pressure corresponds to cylinder 12 being retracted and the IBOP valve being closed. Conversely, sensing low fluid pressure generally corresponds to cylinder 12 being extended and the IBOP valve being open. Sensing low fluid pressure may also indicate a system fault in some cases. In an example of such case, the IBOP valve being closed may be reliably indicated when high fluid pressure is detected by a sensor 17.

Based on an output of a sensor 17, one or more I/O devices 19 (e.g., LED lights, a speaker, a display, network notification device, etc.) may be controlled to indicate a state of IBOP actuation cylinder 10 and/or the IBOP valve to an operator. For example, a green light may be illuminated if IBOP actuation cylinder 10 is retracted and therefore the IBOP valve is closed (e.g. high pressure is detected by a sensor 17).

Figure 1A:
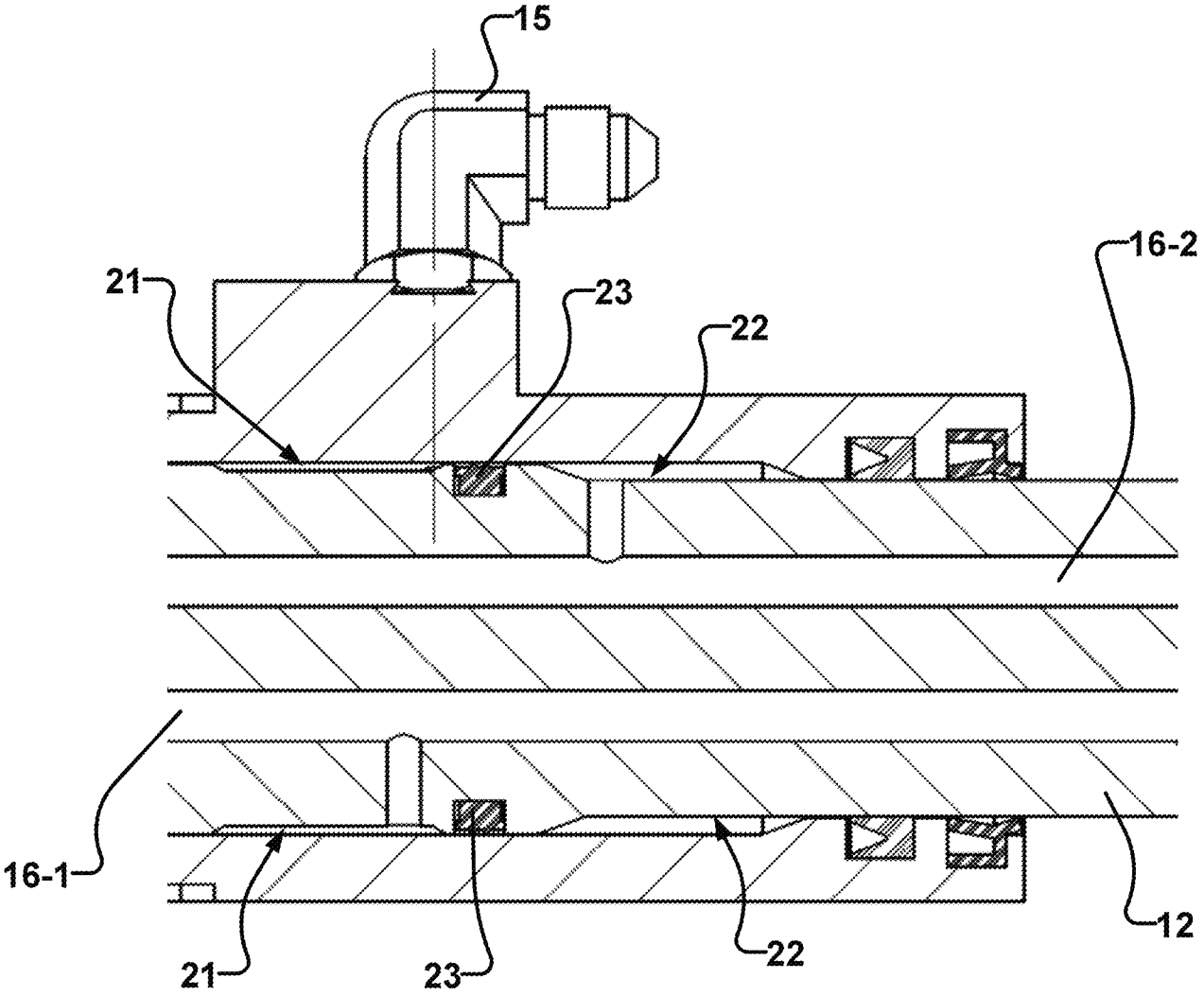
FIG. 1A is a partial zoomed-in cross-sectional view of the IBOP actuation cylinder of FIG. 1.

As shown in FIG. 1, IBOP actuation cylinder 10 comprises first and second cavities 21 and 22 respectively which may be separated from one another by a fluid seal 23. FIG. 1A is a zoomed-in partial cross-sectional view of IBOP actuation cylinder 10 showing cavities 21 and 22. Cavity 21 may be fluidly coupled to a first high pressure hydraulic fluid passage 16-1. Cavity 22 may be fluidly coupled to a second low pressure hydraulic fluid passage 16-2. Seal 23 may, for example, comprise an O-ring, some other form of hydraulic seal (e.g., a bi-directional piston seal, two uni-directional piston seals positioned back-to-back, etc.) and/or the like. When cylinder 12 is retracted, pilot port 15 is fluidly coupled to cavity 21. When cylinder 12 is extended, pilot port 15 is fluidly coupled to cavity 22.

Fluid passages 16-1 and 16-2 may extend through cylinder 12 (see e.g., FIG. 1).

Figure 1B:
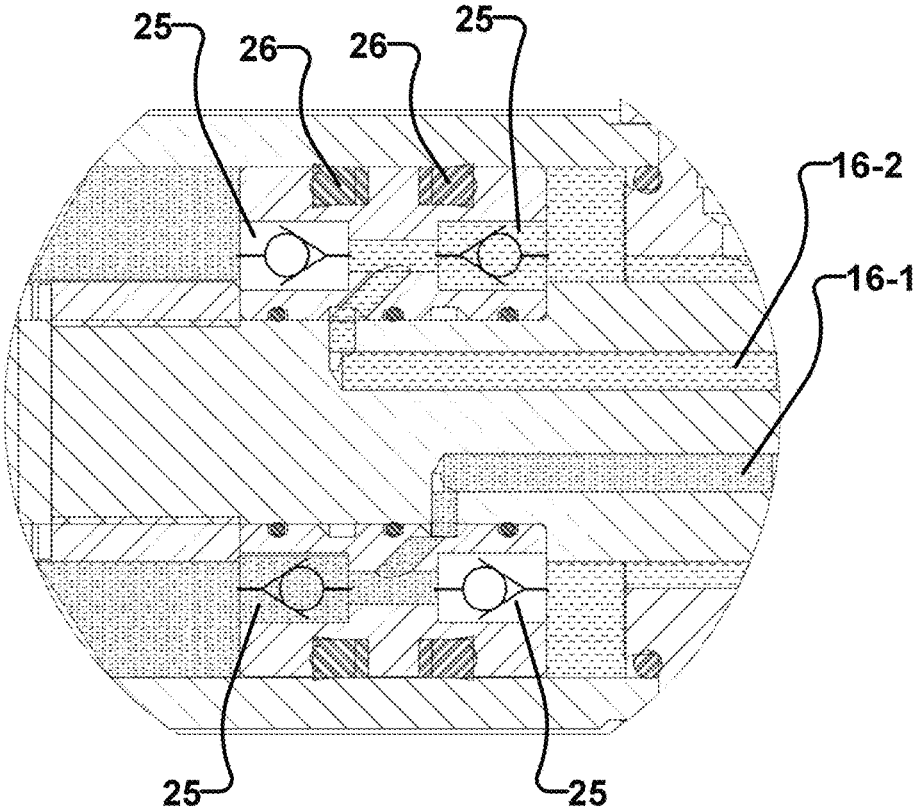
FIG. 1B is a schematic partial zoomed-in cross-sectional view of the IBOP actuation cylinder of FIG. 1.
Figure 1C:
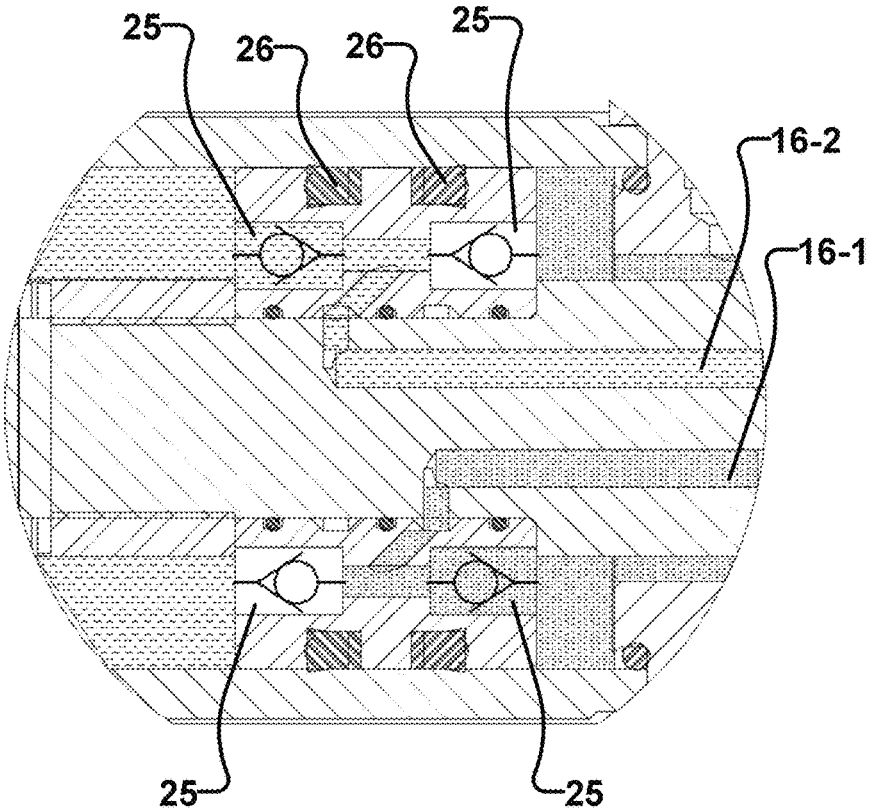
FIG. 1C is a schematic partial zoomed-in cross-sectional view of the IBOP actuation cylinder of FIG. 1.

A plurality of valves 25 (e.g., one-way valves such as one-way check valves) fluidly couple hydraulic ports 13 and 14 to fluid passages 16-1 and 16-2 appropriately while separating high pressure and low pressure fluid as desired. Valves 25 fluidly couple the high pressure one of ports 13 and 14 to high pressure hydraulic fluid passage 16-1. Valves 25 fluidly couple the low pressure one of ports 13 and 14 to low pressure hydraulic fluid passage 16-2. Valves 25 may move with cylinder 12. In some embodiments valves 25 are coupled to cylinder 12. In some embodiments one or more seals 26 (e.g., O-rings, piston seals and/or other hydraulic seals, etc.) further separate high pressure and low pressure fluid as desired. FIGS. 1B and 1C are zoomed in cross-sectional views of detail A from FIG. 1. In the FIG. 1B illustration, high-pressure hydraulic fluid from port 13 is in communication (via valves 25) with high-pressure passage 16-1 and low-pressure hydraulic fluid from port 14 is in communication with low-pressure passage 16-2, which may correspond to the retracted cylinder/closed IBOP valve configuration shown in FIG. 2. In the FIG. 1C illustration, high-pressure hydraulic fluid from port 14 is in communication (via valves 25) with high-pressure passage 16-1 and low-pressure hydraulic fluid from portion 13 is in communication with low-pressure passage 16-2, which may correspond to extended cylinder/open IBOP valve configuration shown in FIG. 4.

Figure 2:
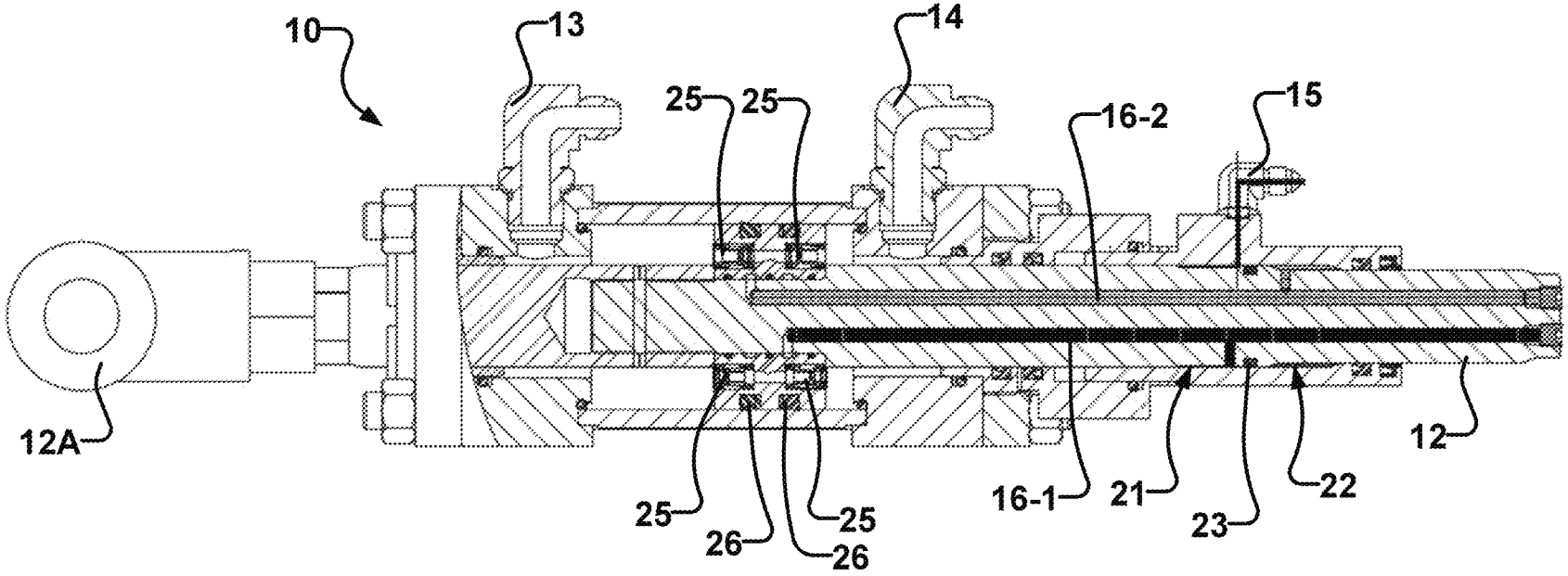
FIG. 2 is a partial cross-sectional view of an example IBOP actuation cylinder.

FIG. 2 illustrates an example case where cylinder 12 is retracted and therefore the IBOP valve is closed.

Figure 3:
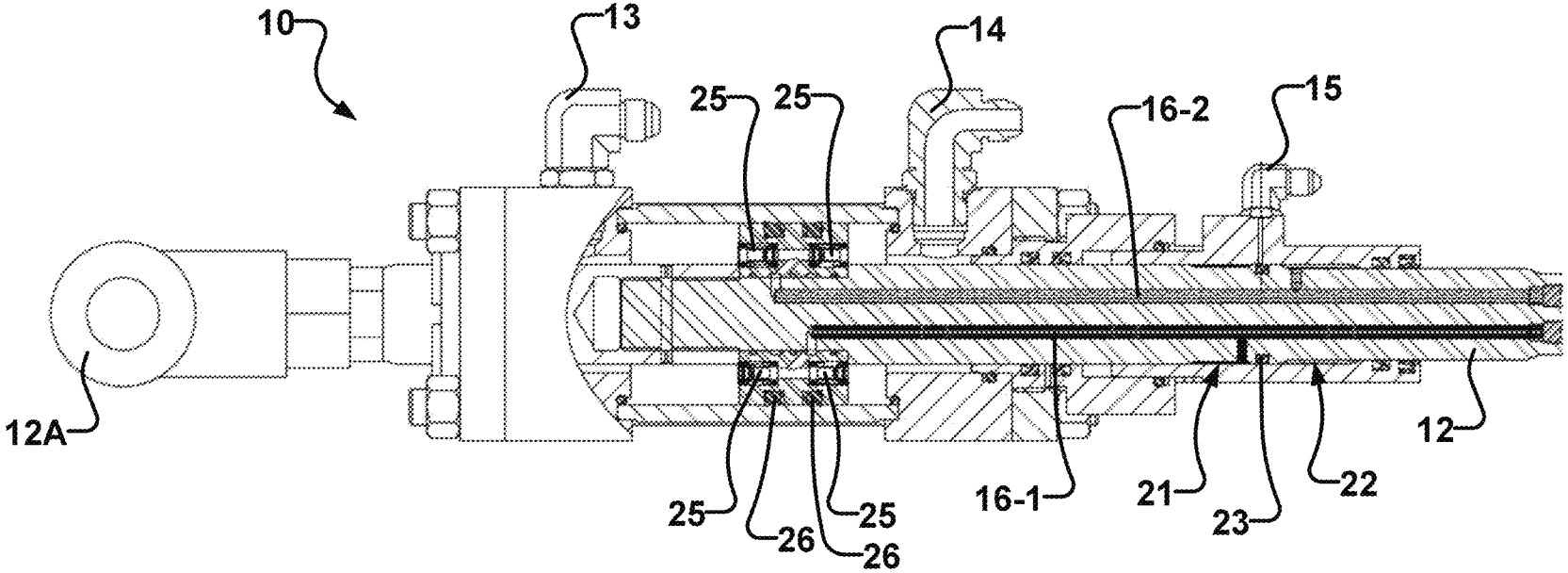
FIG. 3 is a partial cross-sectional view of an example IBOP actuation cylinder.

FIG. 3 illustrates an example case where cylinder 12 is in a transition state (e.g., is partially extended) and therefore the IBOP valve is in a transition state (e.g., the IBOP valve is partially open).

Figure 4:
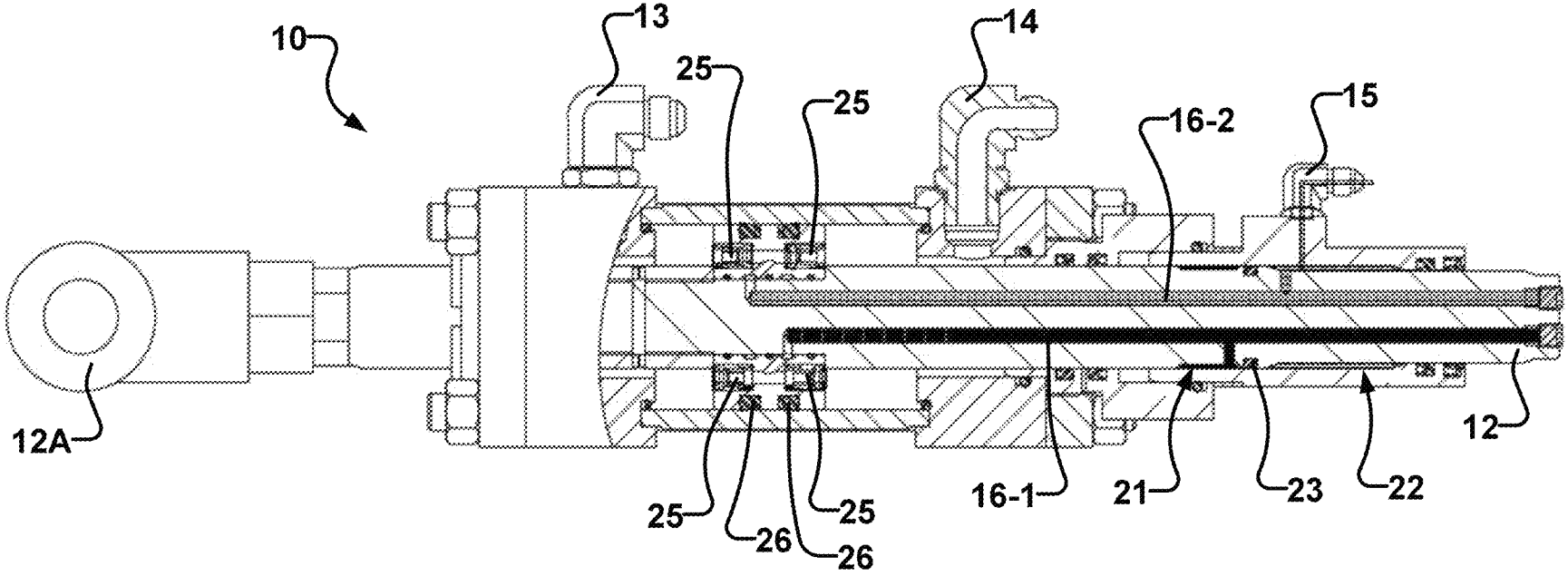
FIG. 4 is a partial cross-sectional view of an example IBOP actuation cylinder.

FIG. 4 illustrates an example case where cylinder 12 is extended and therefore the IBOP valve is open.

In the drawings, the denser hatching schematically represents high pressure fluid and the less dense hatching schematically represents low pressure fluid.

Comparing FIGS. 2, 3 and 4, it can be appreciated that: (i) when cylinder 12 is retracted (the condition shown in FIG. 2), pilot port 15 is fluidly coupled to high-pressure cavity 21, so that pressure sensor 17 (FIG. 1) measures high pressure indicative of cylinder 12 being retracted and the IBOP valve being closed; and (ii) when cylinder 12 is extended (the condition shown in FIG. 4), pilot port 15 is fluidly coupled to low-pressure cavity 22, so that pressure sensor 17 (FIG. 1) measures low pressure indicative of cylinder 12 being extended and the IBOP valve being open. Advantageously, IBOP actuation cylinder 10 of the illustrated embodiment provides measurements at pilot port 15 which are directly indicative of the position/configuration of cylinder 12 and, consequently, avoid erroneous conclusions about the state of the IBOP valve.

Consider, for example, the above-described example situation where cylinder 12 starts in its extended state shown in FIG. 4 (i.e., IBOP open with high pressure hydraulic fluid at port 14 and low pressure hydraulic fluid at port 13) and then the pressure at ports 13, 14 is switched to provide high pressure hydraulic fluid at port 13 and low pressure hydraulic fluid at port 14. If cylinder 12 jams or otherwise does not move, then pilot port 15 remains fluidly connected to low-pressure cavity 22 and, consequently, pressure sensor 17 (FIG. 1) connected to pilot port 15 continues to sense low pressure, leading to the conclusion that cylinder 12 has not transitioned to a retracted state and IBOP valve remains open. Even if cylinder 12 starts to move but is transitioning between its extended state (FIG. 4) and its retracted state (FIG. 2), which is a situation illustrated in FIG. 3, then the hydraulic fluid in pilot port 15 remains at low pressure and pressure sensor 17 (FIG. 1) connected to pilot port 15 continues to sense low pressure, leading to the conclusion that cylinder 12 has not transitioned to a retracted state and the IBOP valve has not reach a closed state. Only when cylinder 12 has moved to its retracted state (FIG. 2), is pilot port 15 in communication with high-pressure cavity 21 so that pressure sensor 17 measures high pressure in pilot port 15, leading to the conclusion that cylinder 12 is retracted and the IBOP valve is closed.

Consider, the converse example, where cylinder 12 starts in its retracted state shown in FIG. 2 (i.e., IBOP closed with high pressure hydraulic fluid at port 13 and low pressure hydraulic fluid at port 14) and then the pressure at ports 13, 14 is switched to provide low pressure hydraulic fluid at port 13 and high pressure hydraulic fluid at port 14. If cylinder 12 jams or otherwise does not move, then pilot port 15 remains fluidly connected to high-pressure cavity 21 and, consequently, pressure sensor 17 (FIG. 1) connected to pilot port 15 continues to sense high pressure, leading to the conclusion that cylinder 12 has not transitioned to an extended state and IBOP valve remains closed. Even if cylinder 12 starts to move but is transitioning between its retracted state (FIG. 2) and its extended state (FIG. 4), which is a situation illustrated in FIG. 3, then the hydraulic fluid in pilot port 15 remains at high pressure and pressure sensor 17 (FIG. 1) connected to pilot port 15 continues to sense high pressure, leading to the conclusion that cylinder 12 has not transitioned to an extended state and the IBOP valve has not reach an open state. Only when cylinder 12 has moved to its extended state (FIG. 4), is pilot port 15 in communication with low-pressure cavity 22 so that pressure sensor 17 measures low pressure in pilot port 15, leading to the conclusion that cylinder 12 is extended and the IBOP valve is open.

A person of skill in the art will recognize that it is possible to modify IBOP actuation cylinder 10 such that different logical conditions lead to a reliable conclusion that the IBOP valve is closed. For example, IBOP actuation cylinder 10 may be modified such that detecting low pressure reliably indicates that the IBOP valve is closed (or in another operating state as desired).

Another aspect of the invention provides a method for detecting and/or monitoring operating states of IBOP actuation cylinder 10 and/or IBOP valves. The method may comprise detecting pressure from the pilot port of IBOP actuation cylinder 10 described herein. Based on the detected pressure a current operating state of IBOP actuation cylinder 10 and/or an IBOP valve may be determined. Based on the current operating state of IBOP actuation cylinder 10 and/or the IBOP valve an operator may, for example, control pumping of drill mud down a drill string. For example, an operator may pump drill mud down the drill string only if the IBOP valve is open. As another example, an operator may cease pumping of drill mud down the drill string, test pressure, etc. if the IBOP valve is indicated to be closed. In some embodiments the method comprises providing for an operator a visual or audio indicator corresponding to a current operating state of IBOP cylinder 10 and/or the IBOP valve (e.g., a green light if IBOP cylinder 10 is retracted meaning the IBOP valve is closed, an alarm if the IBOP valve is not closed, etc.).

Where a component (e.g. a cylinder, hydraulic fluid port, passageway, etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms. These terms ("a", "an", and "the") mean one or more unless stated otherwise;
- "and/or" is used to indicate one or both stated cases may occur, for example A and/or B includes both (A and B) and (A or B);
- "approximately" when applied to a numerical value means the numerical value±10%;
- where a feature is described as being "optional" or "optionally" present or described as being present "in some embodiments" it is intended that the present disclosure encompasses embodiments where that feature is present and other embodiments where that feature is not necessarily present and other embodiments where that feature is excluded. Further, where any combination of features is described in this application this statement is intended to serve as antecedent basis for the use of exclusive terminology such as "solely," "only" and the like in relation to the combination of features as well as the use of "negative" limitation(s)" to exclude the presence of other features; and
- "first" and "second" are used for descriptive purposes and cannot be understood as indicating or implying relative importance or indicating the number of indicated technical features.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a range for a value is stated, the stated range includes all sub-ranges of the range. It is intended that the statement of a range supports the value being at an endpoint of the range as well as at any intervening value to the tenth of the unit of the lower limit of the range, as well as any subrange or sets of sub ranges of the range unless the context clearly dictates otherwise or any portion(s) of the stated range is specifically excluded. Where the stated range includes one or both endpoints of the range, ranges excluding either or both of those included endpoints are also included in the invention.

Certain numerical values described herein are preceded by "about". In this context, "about" provides literal support for the exact numerical value that it precedes, the exact numerical value±5%, as well as all other numerical values that are near to or approximately equal to that numerical value. Unless otherwise indicated a particular numerical value is included in "about" a specifically recited numerical value where the particular numerical value provides the substantial equivalent of the specifically recited numerical value in the context in which the specifically recited numerical value is presented. For example, a statement that something has the numerical value of "about 10" is to be interpreted as: the set of statements:

- in some embodiments the numerical value is 10;
- in some embodiments the numerical value is in the range of 9.5 to 10.5;

and if from the context the person of ordinary skill in the art would understand that values within a certain range are substantially equivalent to 10 because the values with the range would be understood to provide substantially the same result as the value 10 then "about 10" also includes:

- in some embodiments the numerical value is in the range of C to D where C and D are respectively lower and upper endpoints of the range that encompasses all of those values that provide a substantial equivalent to the value 10.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

As will be apparent to those of skill in the art upon reading this disclosure, each of the individual embodiments described and illustrated herein has discrete components and features which may be readily separated from or combined with the features of any other described embodiment(s) without departing from the scope of the present invention.

Any aspects described above in reference to apparatus may also apply to methods and vice versa.

Any recited method can be carried out in the order of events recited or in any other order which is logically possible. For example, while processes or blocks are presented in a given order, alternative examples may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, simultaneously or at different times.

Various features are described herein as being present in "some embodiments". Such features are not mandatory and may not be present in all embodiments. Embodiments of the invention may include zero, any one or any combination of two or more of such features. All possible combinations of such features are contemplated by this disclosure even where such features are shown in different drawings and/or described in different sections or paragraphs. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible). This is the case even if features A and B are illustrated in different drawings and/or mentioned in different paragraphs, sections or sentences.

This disclosure includes a number of non-limiting aspects of the invention. Non-limiting aspects of the invention include:

1. An inside blow-out preventer (IBOP) actuation cylinder comprising:
   a first hydraulic fluid port;
   a second hydraulic fluid port;
   a movable cylinder, the cylinder movable by a difference in hydraulic fluid pressure between the first and second hydraulic fluid ports, the movable cylinder couplable to an IBOP valve or an IBOP valve actuation mechanism, wherein movement of the movable cylinder opens or closes the IBOP valve;
   a pilot port fluidly couplable to at least one pressure sensor configurable to detect pressure of fluid from the pilot port to determine a current state of the movable cylinder.
2. The IBOP actuation cylinder of aspect 1 or any other aspect herein comprising:
   a first cavity fluidly coupled to a high pressure one of the first and second hydraulic fluid ports; and
   a second cavity fluidly coupled to a low pressure one of the first and second hydraulic fluid ports;
   wherein the pilot port is fluidly coupled to the first cavity when the movable cylinder is retracted and the pilot port is fluidly coupled to the second cavity when the movable cylinder is extended.
3. The IBOP actuation cylinder of aspect 2 or any other aspect herein comprising:
   a first fluid passage extending through the movable cylinder, the first fluid passage fluidly coupling the first cavity with the high pressure one of the first and second hydraulic fluid ports; and
   a second fluid passage extending through the movable cylinder, the second fluid passage fluidly coupling the second cavity with the low pressure one of the first and second hydraulic fluid ports.
4. The IBOP actuation cylinder of aspect 3 or any other aspect herein comprising a first fluid seal between the first and second cavities.
5. The IBOP actuation cylinder of aspect 4 or any other aspect herein wherein the first fluid seal comprises an O-ring and/or another form of hydraulic seal.
6. The IBOP actuation cylinder of any one of aspects 3 to 5 or any other aspect herein comprising a plurality of valves configured to fluidly couple the high pressure one of the first and second hydraulic fluid ports to the first fluid passage and the low pressure one of the first and second hydraulic fluid ports to the second fluid passage.
7. The IBOP actuation cylinder of aspect 6 or any other aspect herein wherein the plurality of valves comprises a plurality of one-way valves.
8. The IBOP actuation cylinder of any one of aspects 6 to 7 or any other aspect herein comprising at least a second fluid seal between the first hydraulic port and the second hydraulic port.
9. The IBOP actuation cylinder of aspect 8 or any other aspect herein wherein the second fluid seal comprises an O-ring and/or another form of hydraulic seal.
10. The IBOP actuation cylinder of any one of aspects 6 to 9 or any other aspect herein wherein the plurality of valves are configured to accommodate a switch in pressure of the first and second hydraulic fluid ports from a first state where the first one of the first and second hydraulic fluid ports is the high pressure one of the first and second hydraulic fluid ports and the second one of the first and second hydraulic fluid ports is the low pressure one of the first and second hydraulic fluid ports to a second state where the second one of the first and second hydraulic fluid ports is the high pressure one of the first and second hydraulic fluid ports and the first one of the first and second hydraulic fluid ports is the low pressure one of the first and second hydraulic fluid ports while continuing to direct high-pressure hydraulic fluid from the first and second hydraulic fluid ports to the the first fluid passage and low-pressure hydraulic fluid from the first and second hydraulic fluid ports to the second fluid passage.
11. The IBOP actuation cylinder of any one of aspects 3 to 10 or any other aspect herein wherein when the cylinder is retracted the first cavity comprises high pressure hydraulic fluid.
12. The IBOP actuation cylinder of any one of aspects 3 to 11 or any other aspect herein wherein the high pressure hydraulic fluid comprises hydraulic fluid having a pressure of at least about 500 PSI.

13. A method for determining a current operating state of an inside blow-out preventer (IBOP) actuation cylinder comprising:

detecting pressure of fluid present at a pilot port of the IBOP actuation cylinder using at least one pressure sensor; and based on the detected pressure determining the current operating state of the IBOP actuation cylinder.

14. The method of aspect 13 or any other aspect herein wherein the IBOP actuation cylinder comprises a cylinder moveable between an extended position (e.g. to open the IBOP valve) and a retracted position (e.g. to close the IBOP valve) and wherein detecting pressure of fluid present at the pilot port of the IBOP actuation cylinder comprises fluidly connecting the pilot port to a source of high-pressure hydraulic fluid when the moveable cylinder is in one of the extended position and the retracted position and fluidly connecting the pilot port to a source of high-pressure hydraulic fluid when the moveable cylinder is in the other one of the extended position and the retracted position.

15. The method of aspect 14 or any other aspect herein wherein detecting pressure of fluid present at the pilot port of the IBOP actuation cylinder comprises fluidly connecting the pilot port to a source of high-pressure hydraulic fluid only when the moveable cylinder is in one of the extended position and the retracted position and fluidly connecting the pilot port to a source of high-pressure hydraulic fluid only when the moveable cylinder is in the other one of the extended position and the retracted position.

16. The method of any one of aspects 14 to 15 or any other aspect herein wherein the source of high-pressure hydraulic fluid and the source of low-pressure hydraulic fluid are the same sources of hydraulic fluid that move the cylinder between its extended and retracted positions.

17. The method of any one of aspects 14 to 16 or any other aspect herein wherein the sources of high-pressure and low-pressure hydraulic fluid are provided via first and second fluid passages that extend through a body of the cylinder.

18. The method of any one of aspects 13 to 17 or any other aspect herein comprising providing for an operator an indicator corresponding to a current operating state of the IBOP actuation cylinder.

19. The method of aspect 18 or any other aspect herein wherein providing the indicator comprises at least one of illuminating a light device, controlling a speaker, controlling a display and controlling a network notification device when the IBOP actuation cylinder is retracted.

20. Apparatus having any new and inventive feature, combination of features, or sub-combination of features as described herein.

21. Methods having any new and inventive steps, acts, combination of steps and/or acts or sub-combination of steps and/or acts as described herein.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. An inside blow-out preventer (IBOP) actuation cylinder comprising:

a first hydraulic fluid port;

a second hydraulic fluid port;

a movable cylinder movable by a difference in hydraulic fluid pressure between the first and second hydraulic fluid ports, wherein movement of the movable cylinder causes an IBOP valve to open or close;

a pilot port fluidly couplable to at least one pressure sensor configurable to detect pressure of fluid from the pilot port to determine a current state of the movable cylinder;

a first cavity fluidly coupled to a high pressure one of the first and second hydraulic fluid ports;

a second cavity fluidly coupled to a low pressure one of the first and second hydraulic fluid ports;

wherein the pilot port is fluidly coupled to the first cavity when the movable cylinder is retracted and the pilot port is fluidly coupled to the second cavity when the movable cylinder is extended;

a first fluid passage extending through the movable cylinder, the first fluid passage fluidly coupling the first cavity with the high pressure one of the first and second hydraulic fluid ports; and a second fluid passage extending through the movable cylinder, the second fluid passage fluidly coupling the second cavity with the low pressure one of the first and second hydraulic fluid ports.

2. The IBOP actuation cylinder of claim 1 comprising a first fluid seal between the first and second cavities.

3. The IBOP actuation cylinder of claim 2 wherein the first fluid seal comprises an O-ring and/or another form of hydraulic seal.

4. The IBOP actuation cylinder of claim 1 comprising a plurality of valves configured to fluidly couple the high pressure one of the first and second hydraulic fluid ports to the first fluid passage and the low pressure one of the first and second hydraulic fluid ports to the second fluid passage.

5. The IBOP actuation cylinder of claim 4 wherein the plurality of valves comprises a plurality of one-way valves.

6. The IBOP actuation cylinder of claim 4 comprising at least a second fluid seal between the first hydraulic fluid port and the second hydraulic fluid port.

7. The IBOP actuation cylinder of claim 6 wherein the second fluid seal comprises an O-ring and/or another form of hydraulic seal.

8. The IBOP actuation cylinder of claim 4 wherein the plurality of valves are configured to accommodate a switch in pressure of the first and second hydraulic fluid ports from a first state where the first one of the first and second hydraulic fluid ports is the high pressure one of the first and second hydraulic fluid ports and the second one of the first and second hydraulic fluid ports is the low pressure one of the first and second hydraulic fluid ports to a second state where the second one of the first and second hydraulic fluid ports is the high pressure one of the first and second hydraulic fluid ports and the first one of the first and second hydraulic fluid ports is the low pressure one of the first and second hydraulic fluid ports while continuing to direct high-pressure hydraulic fluid from the first and second hydraulic fluid ports to the first fluid passage and low-pressure hydraulic fluid from the first and second hydraulic fluid ports to the second fluid passage.

9. The IBOP actuation cylinder of claim 1 wherein when the movable cylinder is retracted the first cavity comprises high pressure hydraulic fluid.

10. The IBOP actuation cylinder of claim 9 wherein the high pressure hydraulic fluid comprises hydraulic fluid having a pressure of at least about 500 PSI.

* * * * *